US006257666B1

(12) United States Patent
Struppler

(10) Patent No.: US 6,257,666 B1
(45) Date of Patent: Jul. 10, 2001

(54) OFFICE CHAIR

(76) Inventor: Andreas Struppler, Dreifaltigkeitsplatz 3, D-80331 Munich (DE)

( * ) Notice: Subject to any disclaimer, the term of this patent is extended or adjusted under 35 U.S.C. 154(b) by 0 days.

(21) Appl. No.: 09/478,791

(22) Filed: Jan. 7, 2000

(30) Foreign Application Priority Data

Jan. 8, 1999 (DE) ..... 199 00 454

(51) Int. Cl.[7] ..... A47C 1/024
(52) U.S. Cl. ..... 297/302.4; 297/329
(58) Field of Search ..... 297/300.5, 302.4, 297/325, 329, 344.1, 302.1, 302.2, 303.4

(56) References Cited

U.S. PATENT DOCUMENTS 2,152,024 * 3/1939 Brosset ..... 297/302.4 X
3,232,574 * 2/1966 Ferro ..... 297/329 X
4,858,993 * 8/1989 Steinmann ..... 247/302.4 X
5,577,802 * 11/1996 Cowan et al. ..... 297/302.4
5,918,935 * 7/1999 Stulik et al. ..... 297/302.4 X

FOREIGN PATENT DOCUMENTS 29600821 7/1997 (DE) .
0 669 816 B1 3/1995 (EP) .

* cited by examiner

*Primary Examiner*—Peter R. Brown
(74) *Attorney, Agent, or Firm*—Laubscher & Laubscher

(57) ABSTRACT

An office chair with a pedestal (14) and, attached thereto, a seat carrier (13) that carries a seat element (10) and that can be shifted with relation to the pedestal (14) out of an initial position (a) against the restoring spring force along a guide track that when the chair is inclined rearwardly relative to the vertical direction. To improve sitting comfort, the increase in the restoring spring force along the shifting path in a first shifting path segment adjoining the initial position is greater than in a second shifting path segment that is spaced away from the initial position (FIG. 2).

10 Claims, 3 Drawing Sheets

FIG. 1
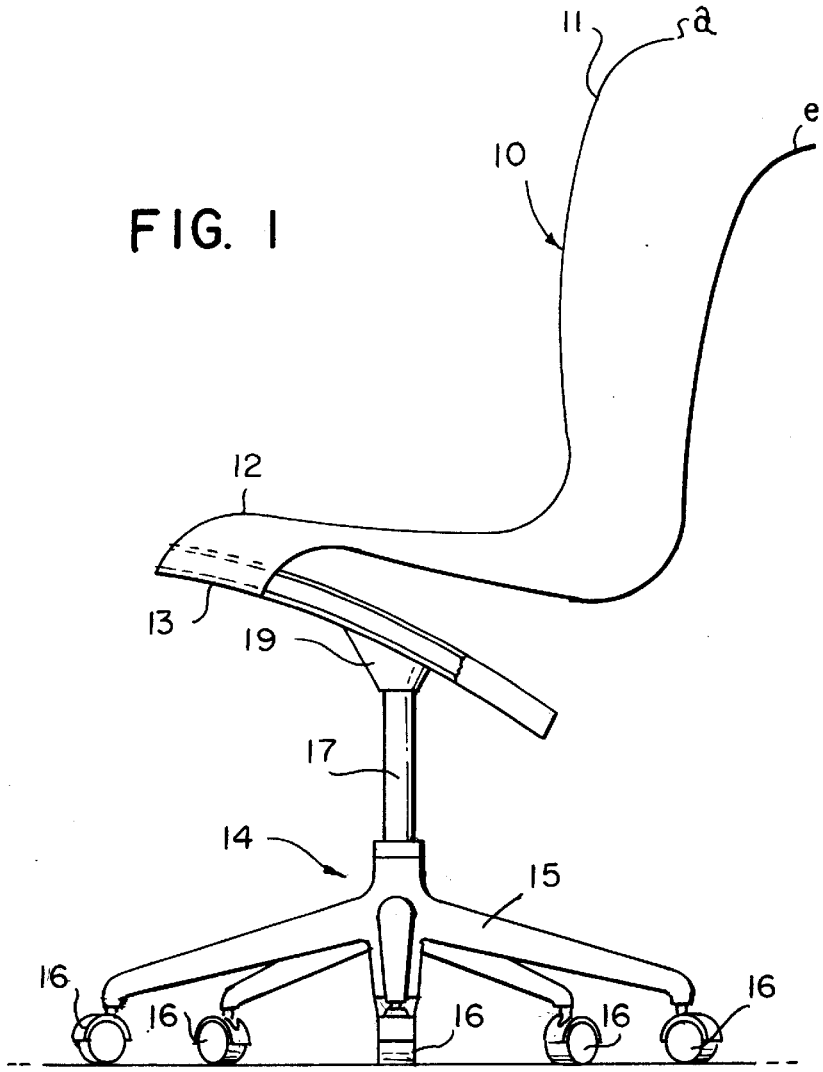
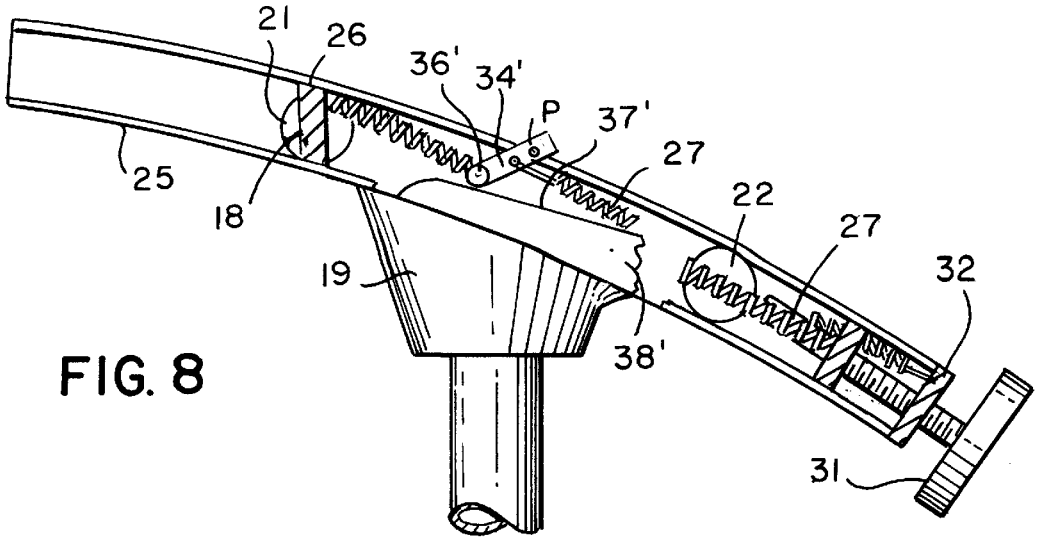
FIG. 8

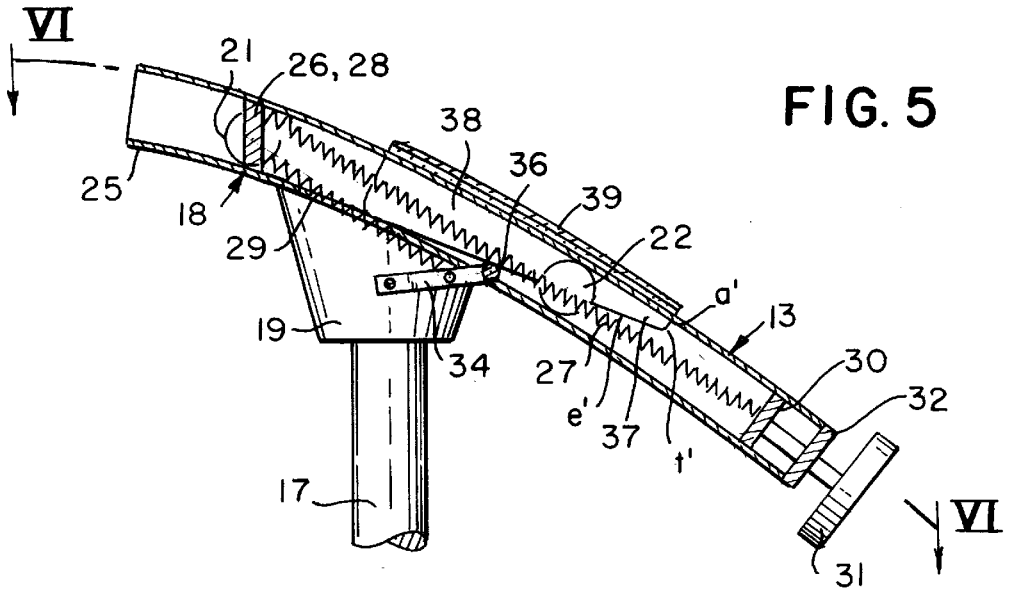
FIG. 5
FIG. 6
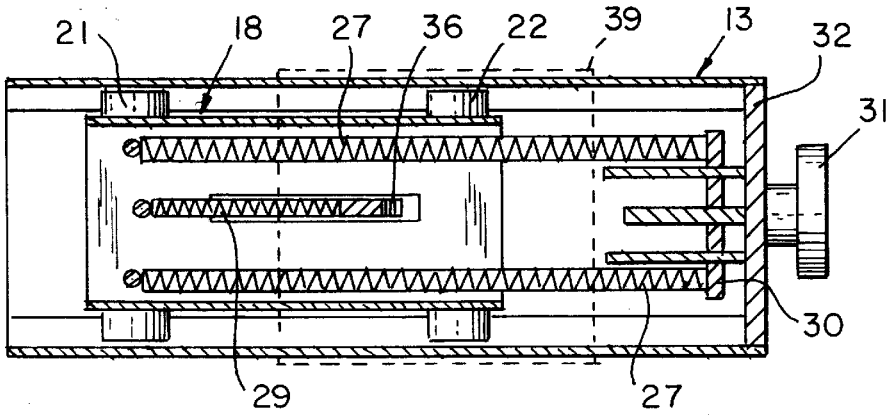
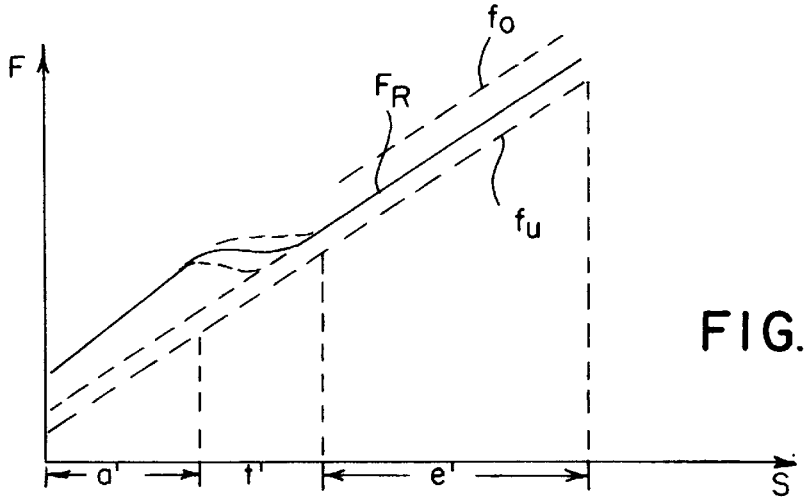
FIG. 7

OFFICE CHAIR

BACKGROUND OF THE INVENTION

1. Field of the Invention

This invention relates to a chair, especially an office chair with a pedestal and a seat carrier that bears a seat element and that is attached to the pedestal.

2. Brief Description of the Prior Art

Office chairs are well known and have a long time been used in offices and the like at desks and computer work stations. Along with the resilient support of the seat element in the vertical direction, one can frequently also resiliently adjust the inclination of the seat surface and the backrest, both with respect to the pedestal and with respect to each other.

An office chair is known from the European Patent No. EP 0 669 819 B1 whose seat element can be swung backward and down in the form of a circle arc of a pivot axis that lies roughly in the foot joint of a person sitting thereupon. In order to facilitate this pivotal motion of the seat element that is derived from the ergonomic conditions when sitting on a chair, the seat element is attached in the area of its forward edge to a circle-arc-shaped seat carrier that extends to the rear and downward corresponding to the desired pivot motion. This seat carrier is guided in a sliding manner in a likewise circular-arc-shaped guide element that is attached to a pedestal so that it can extend into the guide element corresponding to the pivotal motion of the seat element against the force of a pressure spring.

In this known chair, both the generally customary vertical elasticity and the pivotal motion of the seat element into a tension release position facilitate relaxed sitting by means of the circle-arc-shaped seat carrier that is supported resiliently; therefore, this known office chair does not have a definitely detectable upright working position for the user.

The object of the present invention is to provide an additional chair that, in particular, enables the user to assume a stable working position without constantly running the risk of sliding away into a tension release position that is inclined to the rear.

SUMMARY OF THE INVENTION

According to a primary object of the invention, in other words, taking a stool whose seat carrier can be shifted with relation to the pedestal from an initial position against a restoring spring force along a guide track toward a second position that is inclined vertically when compared to the normal user position of the chair, it is provided that the increase in the restoring spring force along the shifting path in a first shifting path segment adjoining the initial position be greater than in a second shifting path segment that is spaced away from the initial position. In this way, when initially sitting down on the chair and when subsequently sitting upon the chair, a user does of course feel the usual resiliency connected with a slight backward inclination of the seat element; nevertheless, a stable sitting sensation is transmitted to him because the restoring force spring that pushes the seat element back into its initial position at first increases relatively powerfully.

The seat element of the chair of the present invention is thus cushioned comparatively hard near its initial position so that the particular user can assume a stable seated position. When a person sitting on the seat leans back in relaxation, then due to the design of the spring characteristic, the person gets a pleasant and soft cushioning effect that facilitates comfortable and relaxed sitting. The variously hard cushioning, provided according to the invention, thus improves the sitting comfort; it does this due to the clear differentiation that the user can detect between the initial swing range determined for the working positions and the subsequently following pressure release swing range.

According to another object of the invention, means are provided that generate the restoring spring force, first and second spring means being arranged parallel to each other in terms of effect between the pedestal and the seat carrier; the second spring means along the second shifting path segment does not deliver any restoring force component. This is done to implement in the simplest possible fashion the increase in the restoring force spring, in other words, the spring constant that depends on the shifting path, which increase in the restoring spring force as a function of the position along the guide track.

A particularly advantageous embodiment of the invention provides the following. One end of the second spring means is supported by cam and follower means and one end of the second spring means supported with the other end in terms of effect on the pedestal or the seat carrier is supported on a pivot lever that is retained by a pivot joint in a fixed manner with respect to the pedestal or the seat carrier and whose free end engages a cam surface on the seat carrier or on the pedestal.

By using cam and follower means, in particular, by using a pivot height that when the seat carrier is shifted with respect to the pedestal is pivoted with the help of a cam surface, it is possible in a particularly simple manner to neutralize the effect of a spring that may be required to generate hard cushioning in the initial sector so that following an initial shifting range of the seat carrier, there will be a relatively soft cushioning. Here, the cam means facilitate the operation of the second spring means needed for initial cushioning upon return from the relaxed sitting position into a working position. The spring means are automatically connected to generate the restoring force so that in spite of the backward movement in the transition area between soft and hard cushioning, the user can detect the constant retention or even a slight rise of the restoring spring force. As a result, the user is informed of the return of the chair into the working position range that surrounds the initial position.

An advantageous development of the invention is characterized as follows: The control surface has a first segment that essentially runs laterally with respect to the guide track for the seat carrier and a second segment that essentially is arranged in the direction of the guide track for the seat carrier.

Prestressing means are provided to set the restoring spring force to enable persons of differing weights to use the chair without any loss of comfort.

It is particularly practical when the seat carrier has a guide rail that for the purpose of fixing the guide track corresponds to a guide element retained on the pedestal; one end of the guide rail of the seat carrier is connected with the latter in the area of a forward edge of the seat element.

A particularly advantageous embodiment of the invention is provided so that one can make not only circular-arc-shaped and linear guide tracks but also other curved guide tracks that correspond to the actual ergonomic conditions. The guide element in the direction of the guide track has mutually spaced first and second guide supports that in a guiding manner engage the guide rail. In this way, one can prevent a linear guide contact between the guide rail and the guide element; instead, one can provide a two-point guide, which makes it possible so to design the guide track that a translation movement can be superposed simultaneously in the pure swing motion of the seat element. The seat element therefore can so move to the rear and down as if a corresponding swing axis were to be shifted simultaneously parallel with respect to itself. In that way, when a person leans back in the invention-based chair, one can consider not only the swing motion of the lower leg around the ankle joint but simultaneously also a stretching, in other words, a reduction of the bending of the knee joint.

BRIEF DESCRIPTION OF THE DRAWINGS

Other objects and advantages of the invention will become apparent from a study of the following specification when viewed in the light of the accompanying drawing, in which:

FIG. 1 is schematic illustration of the chair of the present invention with the seat back in the normal and reclined positions, respectively;

FIGS. 4 and 5 are sectional views illustrating the seat carrier guide means when the seat back is in the partially reclined and fully reclined positions, respectively FIG. 6 is a sectional view taken along line VI—VI of FIG. 5;

FIG. 7 is a graphic illustration of the curve of the restoring force plotted as a function of the displacement of the seat path; and FIG. 8 is a sectional view of another embodiment of the apparatus of FIG. 1.

DETAILED DESCRIPTION

Figure 2:
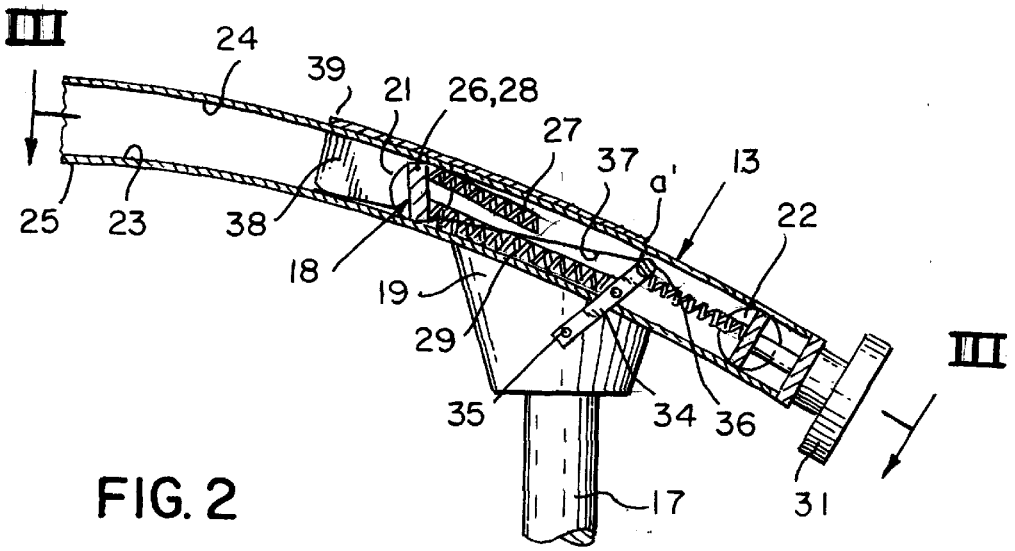
FIG. 2 is a longitudinal sectional view of the seat carrier guide means of FIG. 1 when in the normal seating position.

Referring first to FIG. 1, the chair of the present invention, which is illustrated as being an office chair, has a seat element 10 with backrest 11 and seat surface 12 that in the area of the forward edge of seat surface 12 is attached to a movable seat carrier 13. Seat carrier 13 with seat element 10 can be shifted out of the initial position, labeled a, in a manner to be described in greater detail below, against a restoring force spring with relation to a pedestal 14 into a backward leaning or tension release position e that facilitates relaxed sitting.

In the illustrated office chair, pedestal 14 has a pedestal base 15 with at least five legs to which are attached rollers 16. Pedestal base 15 has a tubular vertical support 17 whose length can be adjusted to adjust the height of seat element 10. To retain and guide the seat carrier 13, a guide element 18 (see FIGS. 2 and 6), not shown in FIG. 1, is attached to the vertical support 17 of pedestal 14 by means of a support head 19.

Instead of the described pedestal 14, one can use also any other pedestal to which one can attach guide element 18 with seat carrier 13 without impairing the shifting motion of seat element 10.

A rigid seat shell can be used as seat element 10. Preference, however, is given to a resilient seat shell, wherein the angle between seat surface 12 and backrest 11 can be expanded owing to its residency. Besides, it is possible to use a seat element where backrest 11 by means of a corresponding adjusting element is so attached to seat surface 12 that the angle between backrest 11 and seat surface 12 can be adjusted.

Figure 3:
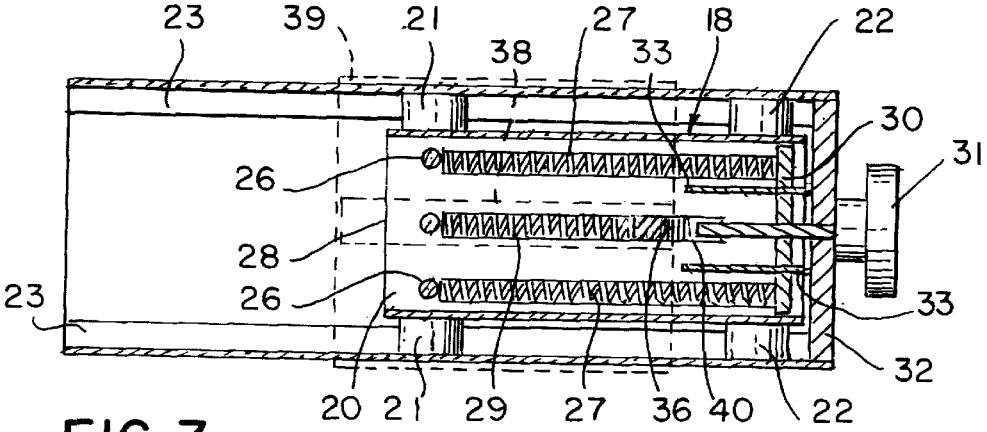
FIG. 3 is a sectional view taken along the line III—III of FIG. 2.

As shown in FIGS. 2 and 3, guide means 18, attached to support head 19, include a stationary frame 20 upon which are attached as guide supports first and second guide rolls 21, 22 that are spaced apart from each other along the longitudinal direction of the frame. In place of rollers, one can also use suitable glide-in pieces or the like as guide supports.

First and second guide rollers 21 and 22 run between lower and upper guide surfaces 23, 24 that are formed on a movable guide rail 25 of seat carrier 13 and that, together with the first and second guide rollers 21, 22 of guide element 18, determine the guide track for shifting seat carrier 13 with respect to pedestal 14 and the frame 20.

Attached to frame 20 of guide element 18 are a pair of spring abutments 26 for a pair of first restoring tension springs 27, and a second spring abutment 28 is provided for an additional tension spring 29.

First restoring springs 27, have first ends connected with the stationary abutments 26 of stationary seat guide means 18 and second ends connected with a transverse bearing plate 30 that, with the help of an adjustment screw 31, is so held upon a support end wall 32 of guide rail 25 and seat carrier 13 that to set a spring prestress, the interval between bearing plate 30 and support plate 32 can be adjusted. Bearing plate 30 and end wall 32, thus together with the adjusting screw, constitute prestressing means for setting the spring tension. The tensioning means can also be provided on seat guide means 18. To ensure the transmission of uniform force from bearing plate 30 to support plate 32 and thus upon seat carrier 13, guide pins 33 are attached to end wall 32. These guide pins extend through corresponding bores contained in bearing plate 30, thereby to prevent tilting of the bearing plate relative to end wall 32.

Second spring means 29 are connected at one end with stationary abutment 28 on frame 20, and at its other end with an intermediate point on pivot lever 34 one end of which is pivotally connected with support head 19 by pivot 35. At its other end, the pivot lever 34 is provided with a cam follower 36 that engages the cam surface 37 of a cam 38. Cam 38 is carried by the cam carrier 39 that is connected with the movable guide rail 25, said cam extending downwardly longitudinally of the guide rail 25 above slot 40 contained in the bottom wall of frame 20, as shown in FIG. 3. Pivotal lever 34 extends upwardly through slot 40 with the follower 36 being biased toward engagement with cam surface 37 by the second spring 29. As will be described in greater detail below, as the assembly comprising the seat carrier 13, guide rail 25, cam carrier 39 and cam 38 is shifted from initial position of FIG. 2 and through the intermediate position of FIG. 4 toward the final position of FIG. 5, lever 34 is pivoted in the clockwise direction about pivot 35 by the cam surface 37, thereby to increase the tension of tension spring 29.

Referring to the second embodiment of FIG. 8, the cam 38' is stationary and is secured to the pedestal head 19, and the pivot lever 34' is pivotally connected with the movable rail means 25 by the pivot P. For this embodiment, the second spring 27 is secured at its other end with the end wall 32 of the movable rail means 25, whereby as the rail means 25 is displaced to the right during movement of the seat toward the reclined relaxed positions, lever 34' is pivoted in the clockwise direction about pivot P as a consequence of the engagement of follower 36' with cam surface 37', thereby to increase the tension of the second spring 27, and thus the restoring force of the second spring 27.

Referring again to FIGS. 4 and 5, the cam surface 37 includes a first end segment a', an intermediate transition segment t', and an inclined main segment e'.

If sliding roller 36 of pivot lever 34 as shown in FIG. 2 rests against a forward segment a' of cam surface 37 that is generally normal with respect to the guide track, then swing lever 34 is pressed with growing force against cam surface 37 in case of a shift of seat carrier 13 with respect to pedestal 14 in correspondence to the growing stretch of the additional second spring 29. This additional force runs essentially parallel to the restoring force of restoring springs 27, both in terms of action and in terms of direction; therefore, for this first shifting range, one gets a larger spring constant for the entire restoring spring arrangement and thus a steeper rise, in other words, a greater increase in the restoring spring force than shown in FIG. 7 for segment a'. The moment —case of a further shift of seat carrier 13—sliding roller 36 with transition segment t' of the control surface 37 (see FIG. 4), the additional force that is transmitted by second spring 29 via pivot lever 34, sliding roller 36 and control surface 37 of connecting link 38 in the direction of the guide track upon connecting link part 39 and thus upon seat carrier 13 is so reduced that in this transition area, the spring constant of the entire spring arrangement becomes at least definitely smaller than the spring constant of the restoring springs 27, preferably zero or even less than zero, as indicated in FIG. 7 for the transition segment t'.

Figure 4:
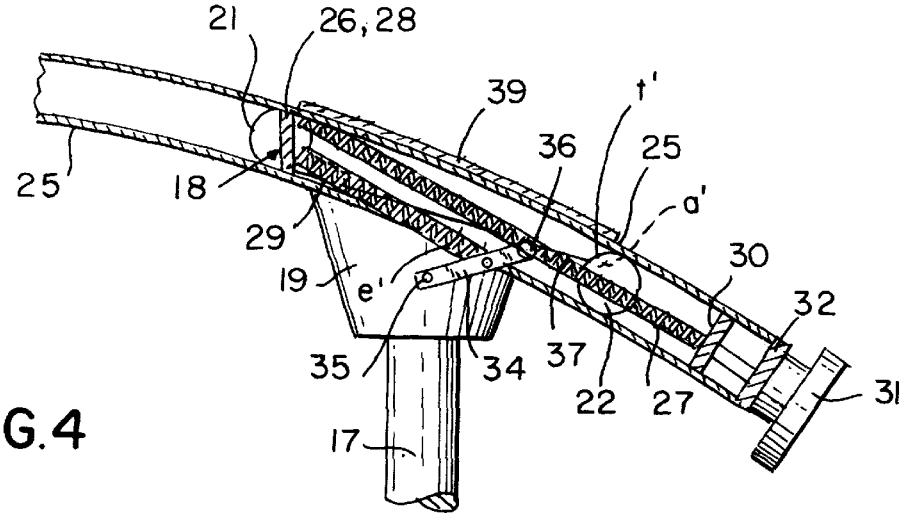

The moment, as shown in FIGS. 4 and 5, sliding roller 36 of swing pivot lever 34 rests on segment e' of cam surface 37 that generally runs parallel to the guide track, then practically none of the additional restoring force brought about by additional spring 29 is transmitted to the seat carrier. In this segment that is labeled e' in FIG. 7, the spring constant of the entire arrangement is determined only be restoring springs 27. The end of the shifting range e' that corresponds to the area of the tension release position e in FIG. 1 is in a practical manner determined by a suitable mechanical stop.

In order to be able to adapt the spring characteristic of the restoring springs 27 and thus the spring characteristic $F_R$ of the entire spring arrangement to the weight of a user in order thus to shift the spring characteristic $F_R$ in the direction F, as indicated by the broken line $f_o$ and $f_t$, the interval between bearing plate 30 and support plate 32 is adjusted with the help of adjusting screw 31; the prestress of springs 27 is thus also set.

The spring arrangement provided according to the invention, comprising a first spring means, that is to say, restoring springs 27, and a second spring means arranged parallel thereto in terms of effect of the additional spring 29 that cooperates with the cam arrangement consisting of pivot lever 34 and control surface 37, facilitates a spring characteristic of a path-dependent restoring spring force, thereby to achieve a working position close to the initial position of the seat has a relatively hard cushion, in other words, a relatively large spring constant. Adjoining the area a', separated by transition area t', there is an area e' with softer cushioning in which the user can sit, leaning back, in a relaxed position.

The curve of the spring constant of the entire spring arrangement can—in the exemplary embodiment described—be adjusted by a suitable design of cam surface 37 on connecting link 38 of connecting link part 39.

In place of the described spring means, one can, however, use also a suitably dimensioned two-stage gas spring or the like as spring arrangement.

Another advantage of the office chair of the present invention results from the guidance of guide rail 25 of seat carrier 13 by means of the first and second guide rollers 21, 22 that are spaced apart from each other in the direction of the guide track. By using a two-point guide in place of a line guide or a three-point guide, one can make any desired guide track so that the backward-downward motion of the seat surface in case of a shift of seat carrier 13 against pedestal 14 can for economic reasons be very accurately adapted to a corresponding shift of the thighs of a user that rest on seat surface 12. This shifting motion of the thighs with the foot fixed in position results from a swing motion of the lower leg around the foot joint and a relative stretch of the knee joint.

The invention thus facilitates an extremely accurate adaptation of the movement of the seat shell of an office chair to the ergonomic conditions in case of dynamic and relaxed sitting.

While in accordance with the provisions of the Patent Statutes the preferred form and embodiments of the invention have been illustrated and described, it will be apparent to those skilled in the art that changes may be made without deviating from the invention set forth in the following claims.

What is claimed is:

1. A chair, comprising:

(a) seat carrier means (13);

(b) support means (14) supporting said seat carrier means above a floor surface;

(c) a seat (10) connected with said seat carrier means, said seat carrier means being generally longitudinally displaceable relative to said support between a normal first position on which said seat is generally erect, and a second position in which said seat is generally reclined; and (d) spring-means normally biasing said seat carrier means toward said first position relative to said support means, said spring means being operable to produce a greater biasing force when said seat carrier means is adjacent said first position than when said seat carrier means is adjacent said second position.

2. A chair as defined in claim 1, wherein said spring means comprises first (27) and second (29) spring means that are parallel with the direction of displacement of said seat carrier means relative to said support means; and further wherein said second spring means is generally inoperable when said seat carrier means is adjacent said second position.

3. A chair as defined in claim 2, and further including cam means (34, 36, 37) for controlling the operation of said second spring means during the displacement of said seat carrier means between said first and second positions.

4. Apparatus as defined in claim 3, wherein said second spring means further includes a pivot lever (34, 34') pivotally connected with one of said seat carrier means and said support means.

5. A chair as defined in claim 4, wherein said cam means includes a cam follower (36) carried by said pivot lever, and a cam member (38) having a cam surface (37) that is arranged generally parallel with the direction of displacement of said seat carrier means relative to said support means, said cam surface having a first portion (a') that extends generally normal to said direction of displacement, and second portion (e') that extends generally parallel with said direction of displacement.

6. A chair as defined in claim 1, and further including means (30, 31, 32) for adjusting the biasing force of said spring means.

7. A chair as defined in claim 1, wherein said support means includes stationary guide means (18); and further wherein said seat carrier means includes guide rail means (25) having tracks (23) connected for movement relative to said stationary guide means.

8. A chair as defined in claim 7, wherein the forward end of said seat is connected with the forward end of said guide rail means.

9. A chair as defined in claim 7, wherein said guide support means includes pairs of guide devices (21, 22) connected in spaced relation relative to the direction of displacement of said guide rail means and said guide support means, said guide devices being arranged in cooperating engagement with said tracks, respectively.

10. A chair as defined in claim 9, wherein said guide devices comprise two pairs of guide rollers (21, 22) arranged for cooperation with said guide tracks, respectively.

* * * * *